US005472246A

United States Patent [19]

Puric

[11] Patent Number: 5,472,246

[45] Date of Patent: Dec. 5, 1995

[54] INDEPENDENT DUAL DEADBOLT LOCKING MECHANISM

[76] Inventor: Marino Puric, 4819 Birchwood, Skokie, Ill. 60077

[21] Appl. No.: 248,438

[22] Filed: May 24, 1994

[51] Int. Cl.[6] ..... E05C 1/06

[52] U.S. Cl. ..... 292/36; 292/42; 292/156

[58] Field of Search ..... 292/3, 36, 35, 292/40, 42, 156, 158, 139, 359, DIG. 62, DIG. 18, 32; 70/120, 418

[56] References Cited

U.S. PATENT DOCUMENTS

| | | | |
|---|---|---|---|
| 1,909,697 | 5/1933 | MacBeth et al. | 292/359 |
| 3,633,389 | 1/1972 | Horgan, Jr. | 70/120 |
| 3,699,788 | 10/1972 | Gerlach | 292/139 X |
| 5,077,992 | 1/1992 | Su | 292/36 X |

FOREIGN PATENT DOCUMENTS

| | | | |
|---|---|---|---|
| 393791 | 1/1921 | Germany | 70/120 |

*Primary Examiner*—Rodney M. Lindsey
*Attorney, Agent, or Firm*—Lee, Mann, Smith, McWilliams, Sweeney & Ohlson

[57] ABSTRACT

An independent dual deadbolt locking mechanism for securing doors, windows or the like. The dual locking mechanism has a single pivot key that acts to place two deadbolt locks in either a locked or unlocked position simultaneously. The deadbolts may be oriented at various angles to one another. Typically, the deadbolts are oriented at a 90 degree angle from one another, with one deadbolt locking into the side frame of a door, and the other locking into the upper door frame or floor. The mechanical arrangements of the locking mechanism allows one deadbolt to be broken or forced into an unlocked position without affecting or unlocking the other independent deadbolt.

20 Claims, 6 Drawing Sheets

INDEPENDENT DUAL DEADBOLT LOCKING MECHANISM

BACKGROUND OF THE INVENTION

This invention relates generally to a locking mechanism for locking and unlocking doors or similar structures, and more particularly to a locking mechanism having dual deadbolt locks which are protected from being simultaneously forceably opened.

Standard deadbolt door locks are designed to project a single sliding bolt into a socket of a casing of a door. This single sliding bolt construction provides only limited security for doors and windows since there is locking only at one location.

Locking mechanisms have been proposed which have multiple deadbolt locking capabilities for added security. U.S. Pat. No. 1,513,835 discloses a locking device for windows that has a pair of locking bolts movable at right angles to each other. The mechanism of this patent, however, transmits motion from one locking bolt to the other.

U.S. Pat. No. 2,125,227 discloses a locking device for a door which projects a sliding bolt into the side casing of a door and also projects a pair of pins upwardly and downwardly into the lintel and sill of a door. The pins are not independently held in place once being locked.

Although prior multiple locking mechanisms exist, such mechanisms have many of the same failings that single locking mechanisms have. Single deadbolt locks may be forcibly unlocked by forcing the deadbolt back into its chamber with a crow bar or similar object. Multiple deadbolt locking devices are constructed where each deadbolt is always in an interlocking engagement with another deadbolt so whenever there is motion by one deadbolt, an equivalent motion is transferred to the other deadbolt. This transferring of motion is present even when one deadbolt is forced back into its chamber or unlocked position. By forcibly unlocking one deadbolt, the other interlocking deadbolt becomes unlocked as well.

To fully take advantage of a multiple deadbolt locking device, there is a need for a dual locking device that has deadbolts which may be maintained in a locked position independently, regardless of whether one of the deadbolts becomes forcibly unlocked.

SUMMARY OF THE INVENTION

In accordance with the present invention, an independent dual locking mechanism is provided that is ideally suited for securing doors, windows and the like. The locking mechanism, according to the present invention, has the advantage of dual locking deadbolt locks over single deadbolt locking mechanisms. More importantly, the present invention has two deadbolts, that when locked, act independently of each other. Therefore if one lock is forcibly broken or unlocked, the other remains in a locked position.

The dual locking mechanism also has the capability of being adjustable. While preferably the dual deadbolts may be at right angles to each other for interlocking engagement with a socket in the casing of a door and an upper door sash or floor, they also may be oriented with one deadbolt in an upper door sash and the other in the floor. The deadbolts of the locking mechanism may also to adjusted to all other angles between 180 and 0 degrees.

Accordingly, the invention relates to an independent dual locking mechanism comprising two deadbolts, separate means for linking each deadbolt to a single location, actuating means at the single location which is connected to the separate means and used for locking and unlocking the two deadbolts simultaneously while only using a single method of activation, and a means for preventing one deadbolt from becoming unlocked when the other deadbolt is forcibly unlocked or broken.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
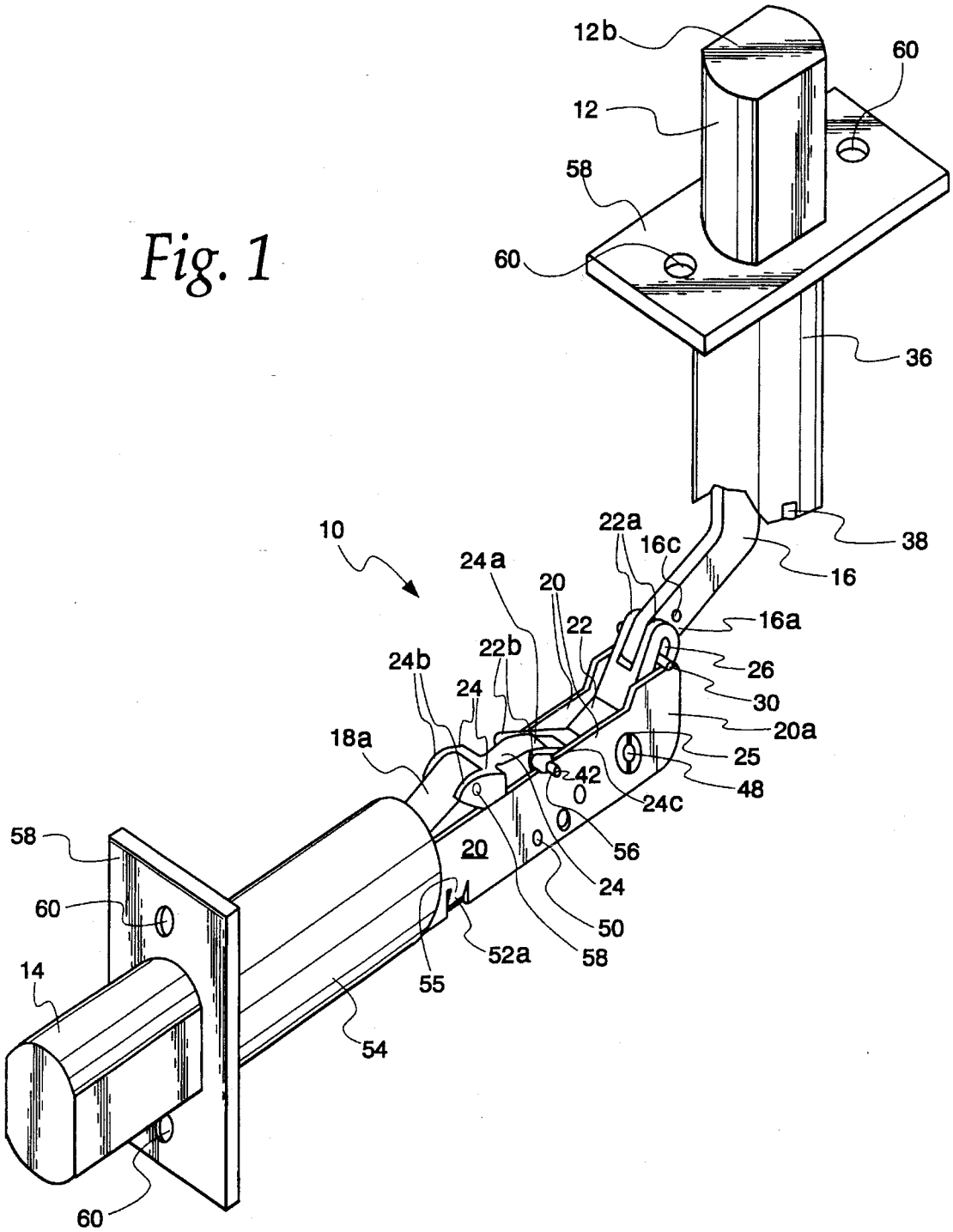
FIG. 1 is a perspective view showing the dual locking mechanism according to the invention with the dual deadbolts disposed at right angles to one another, and with both deadbolts extended in the locked position.

Referring now to the drawings in more detail, reference numeral 10 generally designates an independent dual deadbolt locking mechanism constructed in accordance with a preferred embodiment of the present invention. The mechanism 10 includes a first and second deadbolts 12 and 14, first and second actuators 16 and 18, a housing 20, a main pivot element 22, and a dual pivot link 24.

The main pivot element 22 pivots about a central pivot 25 located at a first end 20a of the housing 20. The main pivot element 22 has first extending arms **22*a* and second extending arms 22*b*. The arms 22*a* include slots 26, and arms 22*b* include slots 28. The first actuator 16 has a first end 16*a* and a second end 16*b*. A series of holes 16*c* are located in the first end 16*a*. The first end 16*a* fits between the arms 22*a* of the main pivot element 22 so that one of the holes 16*c* of the first actuator 16 is positioned between and the slots 26. A pin 30 is secured in the one hole 16*c* and the through the slots 26 to allow the first actuator 16 to pivot about the pin 30 between the arms 22*a***.

Figure 2:
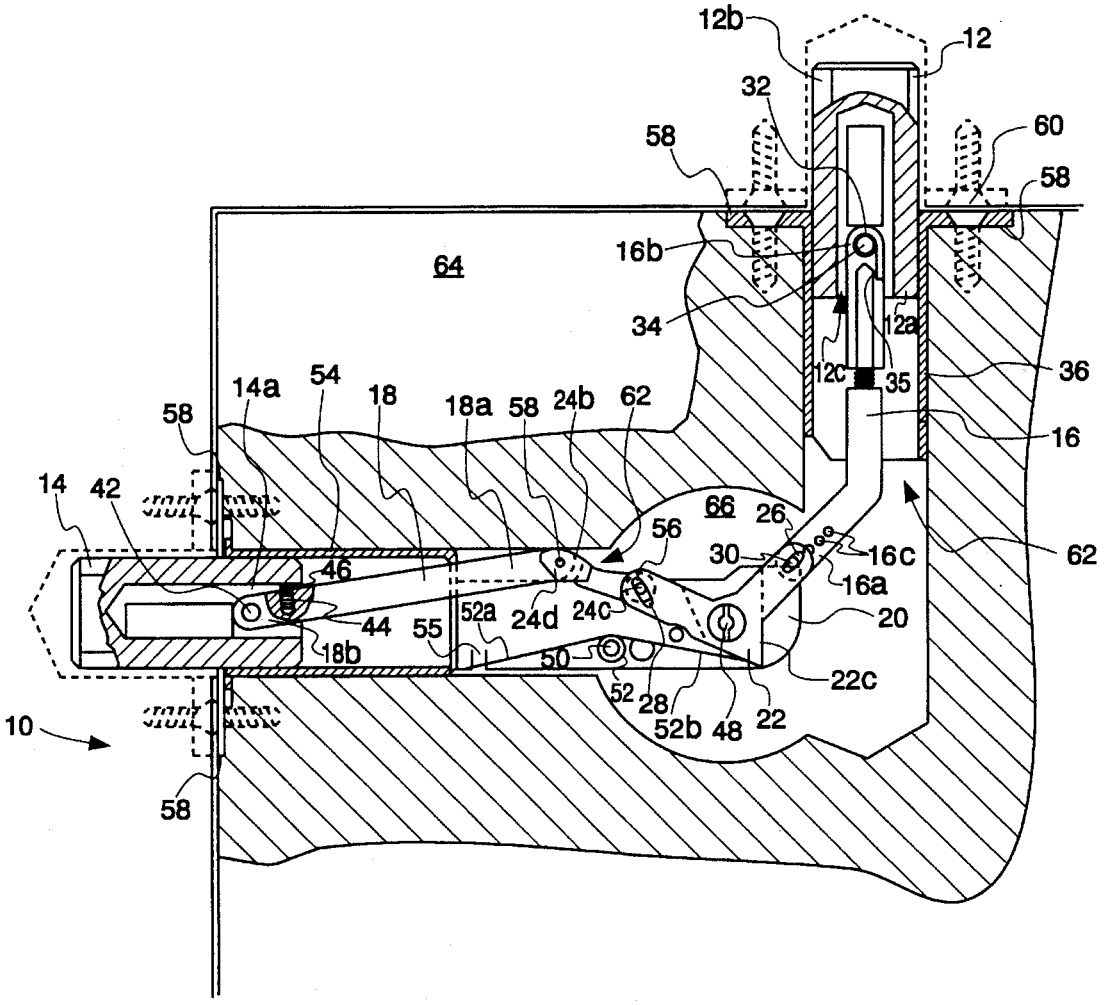
FIG. 2 is an elevational view of the dual locking mechanism, partially in section to show detail, and shown mounted in a door with the deadbolts extended into the locked position.

The first deadbolt 12, as best shown in FIG. 2, has a first end **12*a* and second end 12*b*. The first end 12*a* has a hollowed opening 12*c*. The second end 16*b* of the first actuator 16 extends into the hollow opening 12*c* of the first deadbolt 12. The second end 16*b* has a hole 32 therethrough. A rod 34 is mounted in first deadbolt 12 in opening 12*c* and extends through hole 32 allowing the second end 16*b* of the first actuator 16 to pivot about rod 34. A spring 35 extends around rod 34 and bears against the end 16*b*, biasing the first end 16*a* of the first actuator 16 actuator 16 in a direction toward the second deadbolt 14**, for purposes that will become apparent below.

As seen in FIG. 1, the first deadbolt 12 is slidably mounted inside a hollow first deadbolt housing 36. The first deadbolt housing 36 includes a stop 38 which protrudes inwardly to limit travel as the first deadbolt 12 moves longitudinally through the first deadbolt housing 36. The stop 38 also acts as a stop for the mechanism 10 when the deadbolts 12 and 14 are retracted, as described below.

The dual pivot link 24 has opposite ends 24*a* and 24*b*. The end 24*a* has hole 24*c* therethrough and is located between the arms 22*b* of the main pivot element 22. A pin 42 is mounted in the hole 24*c* and extends through the slots 28 to pivotally connect the end 24*a* of the pivot link 24 to the second set of arms 22*d* of the main pivot element 22. The pin 42 also extends axially beyond the arms 22*b* sufficiently to contact the housing 20. As seen in FIG. 1 and 2, a pair of notches 56 are located on both sides of the housing 20 to receive the extended pin 42 when the locking mechanism 10 is in a locked position.

The second actuator 18 has a first end 18*a* and second end 18*b*. The first end 18*a* has a hole therethrough. The end 24*b* of the dual pivot link 24 consists of two arms 24*d*. A hole extends through each arm 24*d*. The first end 18*a* of the second actuator 18 is positioned between the arms 24*d* of the dual pivot link 24. A pin 58 extends through the holes in the arm 24*d* and the end 18*a* to pivotally connect the end 24*d* of the dual pivot link 24 to the end 18*a* of the second actuator 18.

The second deadbolt 14 is slidably mounted inside a hollow second deadbolt housing 54. The housing 20, as best shown in FIG. 1, is secured to the housing 54. The second end 18*b* of the second actuator 18 extends inside an open end 14*a* of the second deadbolt 14. The second end 18*b* has a hole therethrough. A rod 42 is mounted through the deadbolt 14 inside the open end 14*a* and extends through hole in the end 18*b*, thereby pivotally connecting the second end 18*b* of the second actuator 18 in the second deadbolt 14.

As seen in FIG. 2, the second end 18*b* of the second actuator 18 has a bore 44 that holds a spring 46. The spring 46 biases against and inside the open end 14*a* of the second deadbolt 14 and the bottom of the bore 44, thereby biasing the second actuator 18 outwardly (to the left in FIGS. 2 and 3).

A fixed pivot pin 48 extends through the central pivot 25 of the housing 20. The pivot pin 48 also extends through the center of the main pivot element 22 and thereby acts to pivotally mount the main pivot element 22 inside the housing 20.

Figure 3:
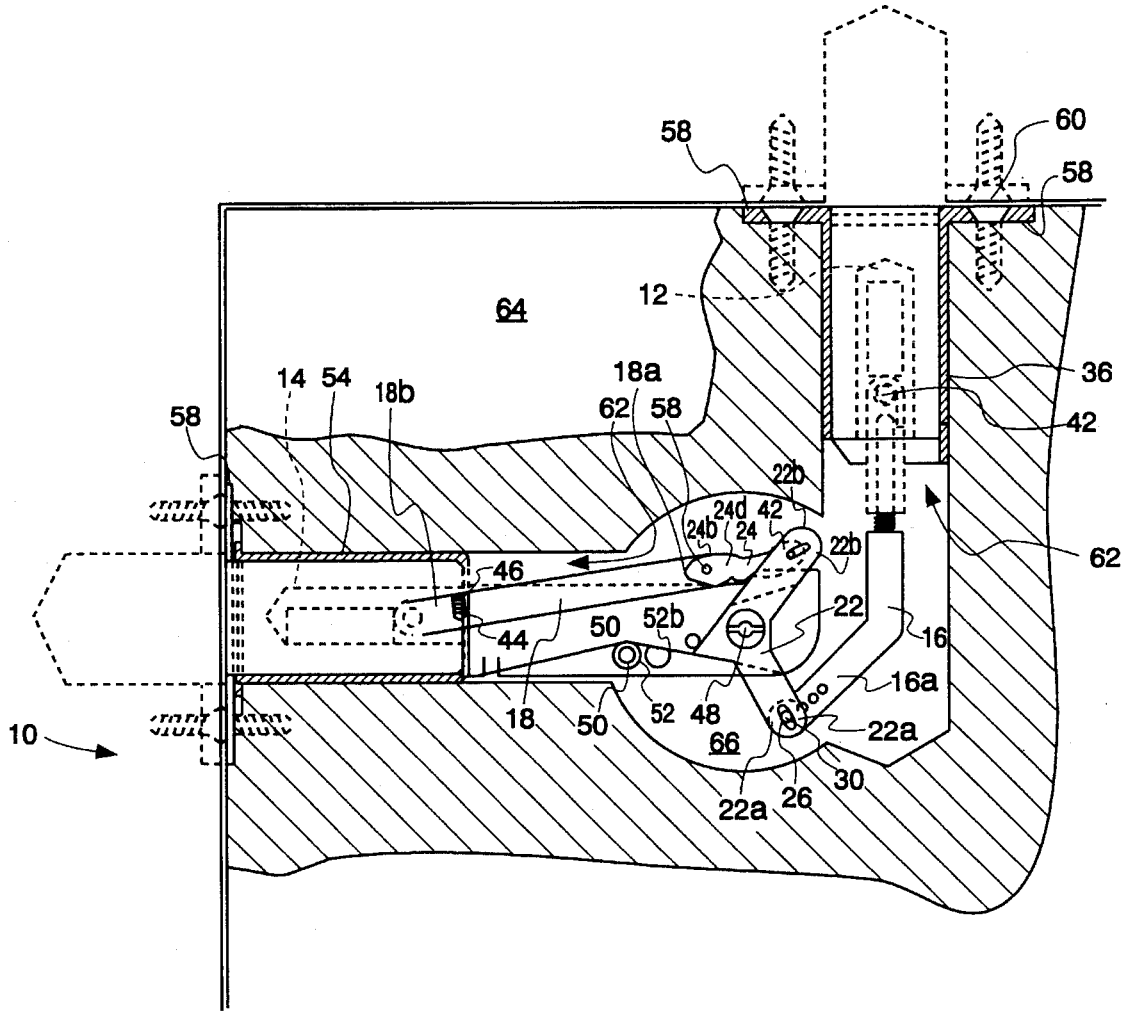
FIG. 3 is an elevational view similar to FIG. 2, but with the deadbolts retracted to an unlocked position.
Figure 4:
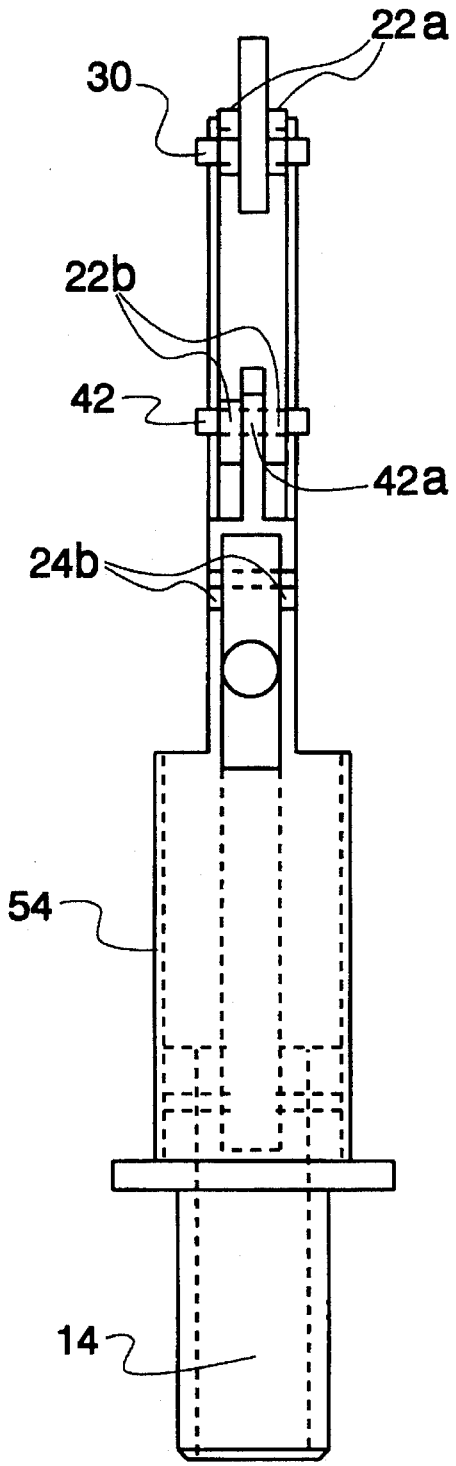
FIG. 4 is a plan view of the only one of the deadbolts, showing the deadbolt in an extended locked position and illustrating its attached locking mechanism.

FIG. 2 and 3 show a rod 50 mounted in the housing 20. A spring 52 is wrapped around rod 50. The spring 52 has a first arm 52*a* extending beneath a stop 55 located in the housing 20. A second spring arm 52*b* extends against and beneath an angled elbow 22*c* of the main pivot element 22 when the locking mechanism is in the unlocked position or the locked position.

Both first and second deadbolt housings 36 and 54 include mounting plates 58. The mounting plates 58 are shaped to orient and guide the deadbolts 12 and 14, and have holes 60 to accommodate mounting of the dual deadbolt locking mechanism to the top, bottom or sides of a door with screws or bolts. As seen in FIG. 2 and 3, when the dual locking mechanism 10 is mounted in a door 64, there are lateral bores 62 in the door 64 to accommodate the positioning of the dual locking mechanism 10 inside the door 64. Also, there is a through bore 66 located where the lateral bores 62 intersect to accommodate rotation of the main pivot element 22 and for insertion of a key or attachment of a handle or knob to the pivot pin 48 for use in locking and unlocking the dual locking mechanism 10.

In operation, to place the dual deadbolt locking mechanism 10 in a locked position from an unlocked position, the pivot pin 48 is turned counter-clockwise (as seen in FIG. 1 and 2). When the pivot pin 48 is turned in the counter-clockwise direction, the attached main pivot element 22 turns in conjunction with the pivot pin 48. The first extending arms 22*a* rotate with the main pivot element 22 forcing the attached first end 16*a* of the first actuator 16 to move inside the first deadbolt housing 36, which causes the first deadbolt 12 to slide through and partially out of the first deadbolt housing 36 to a locked position. Spring 35 biases the actuator end 16*a* in the direction of the second deadbolt 14. This biasing of actuator end 16*a* forces pin 30 to a position adjacent the first end of the housing 20*a* when pivot pin 48 is completely turned in a counterclockwise direction as seen in FIGS. 2 and 3. Once pin 30 is position adjacent the first end 20*a*, the first end 20*a* prevents pin 30 from moving past the first end 20*a* thereby, preventing deadbolt 12 from sliding back through the first deadbolt housing 36 and unlocking of the first deadbolt 12. Only when pivot pin 48 is turned back in the clockwise direction will pin 48 rotate from the first end 20*a* and allow unlocking of the first deadbolt 12.

Figure 6:
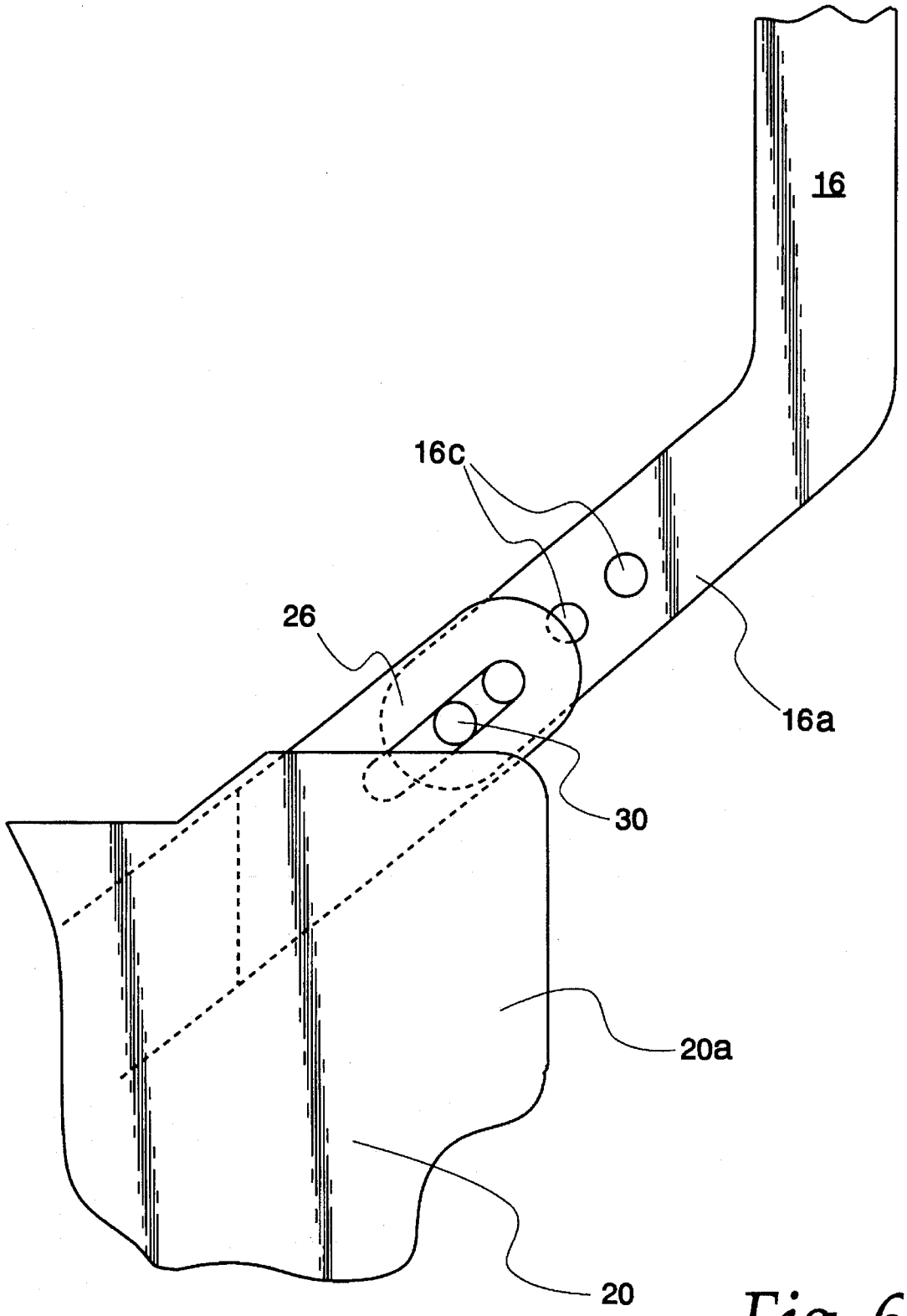
FIG. 6 is an enlarged side elevational view of the pivotal connection between the main pivot element and the first actuator when the first deadbolt is in a locked position.

When the dual locking mechanism 10 is in a locked position, slots 26 holding pin 30 are positioned to guide pin 30 against the edges of the side housing 20 when force is exerted axially on the first deadbolt 12, thereby preventing movement and unlocking of the first deadbolt 12. (As better seen in FIG. 6).

Figure 5:
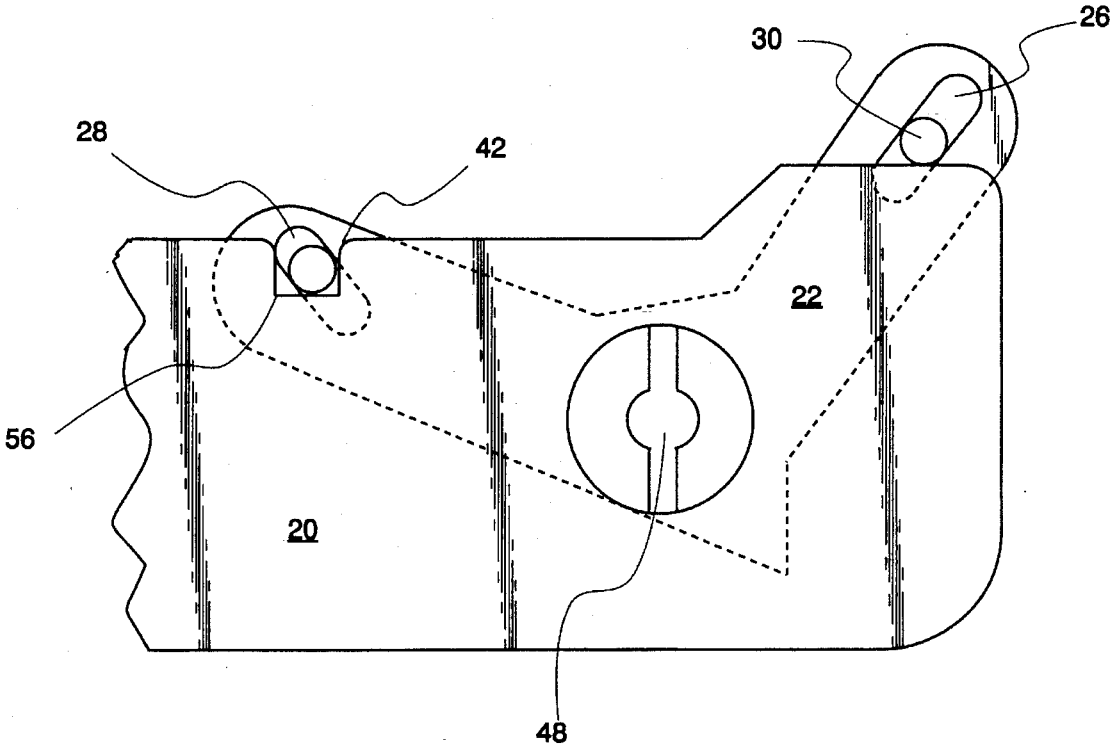
FIG. 5 is an enlarged schematic view of a portion of the invention showing the main pivot element of the dual locking mechanism.

Turning the pivot pin 48 in a counter-clockwise direction also forces the second extending arms 22*b* of the main pivot element 22 to cause the end 24*b* of the dual pivot link 24 to slide along the edges of the housing 20 over and past both notches 56. Pin 42 abuts against the edges of the housing 20 adjacent to notches 56. As the main pivot element 22 continues to rotate in the counter-clock wise direction, pin 42 slides in slots 28, thereby moving past the point where pin 42 initially abuts against the edges of the housing, and moves into notches 56, thereby locking the interconnected second deadbolt 14 in the locked position. (As better seen in FIG. 5).

If a large enough force is exerted axially against the first deadbolt 12 to cause either rod 34, first actuator 16, or pin 30 to break, the locking of the second deadbolt 14 would be unaffected since pin 42 would still be in notches 56, thereby keeping the second deadbolt 14 in a locked position.

Likewise, if a large enough force is exerted axially against the second deadbolt 14 to cause either pin 42 or pin 58 to break, the locking of the first deadbolt 12 would be unaffected since pin 30 would still abut against edge 20*a*, preventing axial movement of the first deadbolt 12 and thereby preventing the first deadbolt 12 from moving into an unlocked position.

Various changes can be made to the invention without departing from the spirit thereof or scope of the claims.

What is claimed is:

1. An independent dual locking mechanism for locking doors and windows, comprising:

a first deadbolt and a second deadbolt;

separate means linking each deadbolt to a single location;

actuating means at said location and connected to said separate means for locking and unlocking the first deadbolt and the second deadbolt simultaneously using only one method of activation; and means associated with each said deadbolt for preventing one deadbolt from becoming unlocked when the other interconnected deadbolt is forcibly unlocked or broken.

2. An independent dual locking mechanism as in claim 1, wherein said first and second interconnected deadbolts may be located at angles of 0 degrees to 180 degrees in relation to one another.

3. An independent dual locking mechanism as in claim 1, wherein said means for preventing one deadbolt from becoming unlocked and said separate means, both include a same first actuator pivotally connected to said first deadbolt, a same main pivot element pivotally mounted inside a housing, said main pivot element having first extending arms and second extending arms, said first extending arms being pivotally connected to said first actuator, a same dual pivot link pivotally connected to said second extending arms, a same second actuator pivotally connected to said dual pivot link, and said second deadbolt pivotally connected to said second actuator.

4. An independent dual locking mechanism as in claim 3, wherein a first pin makes the pivotal connection between said main pivot element and said dual pivot link.

5. An independent dual locking mechanism as in claim 4, wherein a second pin makes the pivotal connection between said first actuator and said first extending arms.

6. An independent dual locking mechanism as in claim 5, wherein said housing has a set of longitudinal edges.

7. An independent dual locking mechanism as in claim 6, wherein said first pin is positioned in a set of notches on the longitudinal edges of said housing whenever said second deadbolt is in a fully extended locked position.

8. An independent dual locking mechanism as in claim 7, wherein said second pin abuts against said longitudinal edges of said housing whenever said first deadbolt is in an extended locked position.

9. An independent dual locking mechanism as in claim 3, wherein the first deadbolt is slidably enclosed in a first deadbolt housing.

10. An independent dual locking mechanism as in claim 9, wherein the first deadbolt housing includes a deadbolt stop.

11. An independent dual locking mechanism as in claim 9, wherein the first deadbolt includes a first mounting plate.

12. An independent dual locking mechanism as in claim 3, wherein said second deadbolt is slidably enclosed in a second deadbolt housing.

13. An independent dual locking mechanism as in claim 12, wherein said second deadbolt includes a second mounting plate.

14. An independent dual locking mechanism, comprising:

a first deadbolt;

a second deadbolt;

means for locking and unlocking said first and second deadbolts simultaneously using only one method of activation; and means for preventing one deadbolt from becoming unlocked when the other deadbolt is forcibly unlocked or broken, said means for preventing one deadlock from becoming unlocked including, a. a first actuator pivotally connected to said first deadbolt;

b. a main pivot element pivotally mounted inside a housing, said main pivot element having first extending arms and second extending arms, said first extending arms being pivotally connected to said first actuator;

c. a dual pivot link pivotally connected to said second extending arms; and d. a second actuator pivotally connected to said dual pivot link said second actuator being pivotally connected to said second deadbolt.

15. An independent dual locking mechanism as in claim 14, wherein a first pin makes the pivotal connection between said main pivot element and said dual pivot link.

16. An independent dual locking mechanism as in claim 15, wherein said housing has a pair of notches, and said first pin is positioned in said notches when said dual locking mechanism is in a locked position.

17. An independent dual locking mechanism as in claim 14, wherein the first deadbolt is slidably enclosed in a first deadbolt housing.

18. An independent dual locking mechanism as in claim 17, wherein the first deadbolt housing includes a deadbolt stop.

19. An independent dual locking mechanism for locking doors and windows, comprising:

a first deadbolt and a second deadbolt;

separate means linking each deadbolt to a single location;

actuating means for locking and unlocking the first deadbolt and the second deadbolt simultaneously using only one method of activation;

means associated with each deadbolt for preventing one deadbolt from becoming unlocked when the other interconnected deadbolt is forcibly unlocked or broken; and means associated with said first and second interconnected deadbolts for allowing said deadbolts to be operatively positioned at angles of 0 to 180 degrees in relation to one another.

20. An independent dual locking mechanism as in claim 19, wherein said means for preventing one deadbolt from becoming unlocked and said separate means, both include a same first actuator pivotally connected to said first deadbolt, a same main pivot element pivotally mounted inside a housing, said main pivot element having first extending arms and second extending arms, said first extending arms being pivotally connected to said first actuator, a same dual pivot link pivotally connected to said second extending arms, a same second actuator pivotally connected to said dual pivot link, and said second deadbolt pivotally connected to said second actuator.

* * * * *